US008817992B2

(12) United States Patent
Vilermo et al.

(10) Patent No.: US 8,817,992 B2
(45) Date of Patent: Aug. 26, 2014

(54) MULTICHANNEL AUDIO CODER AND DECODER

(75) Inventors: Miikka Tapani Vilermo, Tampere (FI); Mikko Tapio Tammi, Tampere (FI)

(73) Assignee: Nokia Corporation, Espoo (FI)

( * ) Notice: Subject to any disclaimer, the term of this patent is extended or adjusted under 35 U.S.C. 154(b) by 486 days.

(21) Appl. No.: 13/058,834

(22) PCT Filed: Aug. 11, 2008

(86) PCT No.: PCT/EP2008/060536

§ 371 (c)(1),
(2), (4) Date: Feb. 11, 2011

(87) PCT Pub. No.: WO2010/017833

PCT Pub. Date: Feb. 18, 2010

(65) Prior Publication Data

US 2012/0134511 A1 May 31, 2012

(51) Int. Cl.
*H04R 5/00* (2006.01)
*G10L 19/008* (2013.01)

(52) U.S. Cl.
CPC ..... *G10L 19/008* (2013.01)
USPC ..... 381/23; 704/500; 700/94

(58) Field of Classification Search
USPC ..... 369/124.08
See application file for complete search history.

(56) References Cited

U.S. PATENT DOCUMENTS

| | | | |
|---|---|---|---|
| 6,539,357 | B1 | 3/2003 | Sinha |
| 2006/0190247 | A1 | 8/2006 | Lindblom |
| 2007/0248157 | A1 | 10/2007 | Den Brinker |

FOREIGN PATENT DOCUMENTS

| | | | |
|---|---|---|---|
| CN | 101120615 | A | 2/2008 |
| EP | 1821287 | A1 | 8/2007 |
| JP | 2003228397 | A | 8/2003 |
| WO | 2004/072956 | A1 | 8/2004 |
| WO | 2005/098825 | A1 | 10/2005 |
| WO | 2006/000952 | A1 | 1/2006 |
| WO | 2006/089570 | A1 | 8/2006 |

OTHER PUBLICATIONS

Baumgarte et al., "Why Binaural Cue Coding Is Better Than Intensity Stereo Coding", Convention Paper presented at the 112th Convention, Audio Engineering Society, May 10-13, 2002, pp. 1-10.
International Search Report received for corresponding Patent Cooperation Treaty Application No. PCT/EP2008/060536, dated Mar. 26, 2009, 15 pages.
Office Action received for corresponding Chinese Patent Application No. 200880131232.3, dated Apr. 6, 2012, 3 pages of Office Action and 4 pages of Office Action translation.
Office Action received for corresponding Chinese Patent Application No. 200880131232.3, dated Sep. 13, 2012, 7 pages of Office Action and 4 pages of Office Action translation.
Herre et al., "Intensity Stereo Coding", Presented at 96th Convention, Audio Engineering Society, Feb. 26-Mar. 1, 1994, 11 pages.

*Primary Examiner* — Davetta W Goins
*Assistant Examiner* — James Mooney
(74) *Attorney, Agent, or Firm* — Nokia Corporation

(57) ABSTRACT

There is disclosed inter alia a method for dividing a first and a second signal into a plurality of time frames and determining for each time frame a first time delay associated with a delay between a start of a time frame of the first signal and the second signal, and determining a second time delay associated with a delay between an end of a time frame of the first signal and the second signal. Then selecting from the second signal at least one sample in a block of samples between the first time delay and the second time delay and stretching the selected at least one sample to equal the number of samples of the time frame of the first signal.

20 Claims, 11 Drawing Sheets

MULTICHANNEL AUDIO CODER AND DECODER

RELATED APPLICATION

This application was originally filed as PCT Application No. PCT/EP2008/060536 on Aug. 11, 2008, which is incorporated herein by reference in its entirety.

FIELD OF THE INVENTION

The present invention relates to apparatus for coding and decoding and specifically but not only for coding and decoding of audio and speech signals

BACKGROUND OF THE INVENTION

Spatial audio processing is the effect of an audio signal emanating from an audio source arriving at the left and right ears of a listener via different propagation paths. As a consequence of this effect the signal at the left ear will typically have a different arrival time and signal level to that of the corresponding signal arriving at the right ear. The difference between the times and signal levels are functions of the differences in the paths by which the audio signal travelled in order to reach the left and right ears respectively. The listener's brain then interprets these differences to give the perception that the received audio signal is being generated by an audio source located at a particular distance and direction relative to the listener.

An auditory scene therefore may be viewed as the net effect of simultaneously hearing audio signals generated by one or more audio sources located at various positions relative to the listener.

The mere fact that the human brain can process a binaural input signal in order to ascertain the position and direction of a sound source can be used to code and synthesise auditory scenes. A typical method of spatial auditory coding may thus attempt to model the salient features of an audio scene, by purposefully modifying audio signals from one or more different sources (channels). This may be for headphone use defined as left and right audio signals. These left and right audio signals may be collectively known as binaural signals. The resultant binaural signals may then be generated such that they give the perception of varying audio sources located at different positions relative to the listener. The binaural signal differs from a stereo signal in two respects. Firstly, a binaural signal has incorporated the time difference between left and right is and secondly the binaural signal employs the "head shadow effect" (where a reduction of volume for certain frequency bands is modelled).

Recently, spatial audio techniques have been used in connection with multi-channel audio reproduction. The objective of multichannel audio reproduction is to provide for efficient coding of multi channel audio signals comprising a plurality of separate audio channels or sound sources. Recent approaches to the coding of multichannel audio signals have centred on the methods of parametric stereo (PS) and Binaural Cue Coding (BCC). BCC typically encodes the multichannel audio signal by down mixing the input audio signals into either a single ("sum") channel or a smaller number of channels conveying the "sum" signal. In parallel, the most salient inter channel cues, otherwise known as spatial cues, describing the multi-channel sound image or audio scene are extracted from the input channels and coded as side information. Both the sum signal and side information form the encoded parameter set which can then either be transmitted as part of a communication chain or stored in a store and forward type device. Most implementations of the BCC technique typically employ a low bit rate audio coding scheme to further encode the sum signal. Finally, the BCC decoder generates a multi-channel output signal from the transmitted or stored sum signal and spatial cue information. Typically down mix signals employed in spatial audio coding systems are additionally encoded using low bit rate perceptual audio coding techniques such as AAC to further reduce the required bit rate.

Multi-channel audio coding where there is more than two sources have so far only been used in home theatre applications where bandwidth is not typically seen to be a major limitation. However multi-channel audio coding may be used in emerging multi-microphone implementations on many mobile devices to help exploit the full potential of these multi-microphone technologies. For example, multi-microphone systems may be used to produce better signal to noise ratios in communications in poor audio environments, by for example, enabling an audio zooming at the receiver where the receiver has the ability to focus on a specific source or direction in the received signal. This focus can then be changed dependent on the source required to be improved by the receiver.

Multi-channel systems as hinted above have an inherent problem in that an N channel/microphone source system when directly encoded produces a bit stream which requires approximately the N times the bandwidth of a single channel.

This multi-channel bandwidth requirement is typically prohibitive for wireless communication systems.

It is known that it may be possible to model a multi-channel/multi-source system by assuming that each channel has recorded the same source signals but with different time-delay and frequency dependent amplification characteristics. In some approaches used to reduce the bandwidth requirements (such as the binaural coding approached described above), it has been believed that the N channels could be joined into a single channel which is level (intensity) and time aligned. However this produces a problem in that the level and time alignment differs for different time and frequency elements. Furthermore there are typically several source signals occupying the same time-frequency location with each source signal requiring a different time and level alignment.

A separate approach that has been proposed has been to solve the problem of separating all of the audio sources (in other words the original source of the audio signal which is then detected by the microphone) from the signals and modelling the direction and acoustics of the original sources and the spaces defined by the microphones. However, this is computationally difficult and requires a large amount of processing power. Furthermore this approach may require separately encoding all of the original sources, and the number of original sources may exceed the number of original channels. In other words the number of modelled original sources may be greater than the number of microphone channels used to record the audio environment.

Currently therefore systems typically only code a multi-channel system as a single or small number of channels and code the other channels as a level or intensity difference value from the nearest channel. For example in a two (left and right) channel system typically a single mono-channel is created by averaging the left and right channels and then the signal energy level in the frequency band for both the left and right channels in a two-channel system is quantized and coded and stored/sent to the receiver. At the receiver/decoder, the mono-signal is copied to both channels and the signal levels in the left and right channels are set to match the received energy information in each frequency band in both recreated channels.

This type of system, due to the encoding, produces a less than optimal audio image and is unable to produce the depth of audio that a multi-channel system can produce

SUMMARY OF THE INVENTION

This invention proceeds from the consideration that it is desirable to encode multi-channel signals with much higher quality than previously allowed for by taking into account the time differences between the channels as well as the level differences.

Embodiments of the present invention aim to address the above problem.

There is provided according to a first aspect of the invention an apparatus configured to: determine at least one time delay between a first signal and a second signal; generate a third signal from the second signal dependent on the at least one time delay; and combine the first and third signal to generate a fourth signal.

Thus embodiments of the invention may encode an audio signal and produce audio signals with better defined channel separation without requiring separate channel encoding.

The apparatus may be further configured to encode the fourth signal using at least one of: MPEG-2 AAC, and MPEG-1 Layer III (mp3).

The apparatus may be further configured to divide the first and second signals into a plurality of frequency bands and wherein at least one time delay is preferably determined for each frequency band.

The apparatus may be further configured to divide the first and second signals into a plurality of time frames and wherein at least one time delay is determined for each time frame.

The apparatus may be further configured to divide the first and second signals into at least one of: a plurality of non overlapping time frames; a plurality of overlapping time frames; and a plurality of windowed overlapping time frames.

The apparatus may be further configured to determine for each time frame a first time delay associated with a start of the time frame of the first signal and a second time delay associated with a end of the time frame of the first signal.

The first frame and the second frame may comprise a plurality of samples, and the apparatus may be further configured to: select from the second signal at least one sample in a block defined as starting at the combination of the start of the time frame and the first time delay and finishing at the combination of the end of the time frame and the second time delay; and stretch the selected at least one sample to equal the number of samples of the first frame.

The apparatus may be further configured to determine the at least one time delay by: generating correlation values for the first signal correlated with the second signal; and selecting the time value with the highest correlation value.

The apparatus may be further configured to generate a fifth signal, wherein the fifth signal comprises at least one of: the at least one time delay value; and an energy difference between the first and the second signals.

The apparatus may be further configured to multiplex the fifth signal with the fourth signal to generate an encoded audio signal.

According to a second aspect of the invention there is provided an apparatus configured to: divide a first signal into at least a first part and a second part; decode the first part to form a first channel audio signal; and generate a second channel audio signal from the first channel audio signal modified dependent on the second part, wherein the second part comprises a time delay value and the apparatus is configured to generate the second channel audio signal by applying at least one time shift dependent on the time delay value to the first channel audio signal.

The second part may further comprise an energy difference value, and wherein the apparatus is further configured to generate the second channel audio signal by applying a gain to the first channel audio signal dependent on the energy difference value.

The apparatus may be further configured to divide the first channel audio signal into at least two frequency bands, wherein the generation of the second channel audio signal is preferably modifying each frequency band of the first channel audio signal.

The second part may comprise at least one first time delay value and at least one second time delay value, the first channel audio signal may comprise at least one frame defined from a first sample at a frame start time to a end sample at a frame end time, and the apparatus is preferably further configured to: copy the first sample of the first channel audio signal frame to the second channel audio signal at a time instant defined by the frame start time of the first channel audio signal and the first time delay value; and copy the end sample of the first channel audio signal to the second channel audio signal at a time instant defined by the frame end time of the first channel audio signal and the second time delay value.

The apparatus may be further configured to copy any other first channel audio signal frame samples between the first and end sample time instants.

The apparatus may be further configured to resample the second channel audio signal to be synchronised to the first channel audio signal.

An electronic device may comprise apparatus as described above.

A chipset may comprise apparatus as described above.

An encoder may comprise apparatus as described above.

A decoder may comprise apparatus as described above.

According to a third aspect of the invention there is provided a method comprising: determining at least one time delay between a first signal and a second signal; generating a third signal from the second signal dependent on the at least one time delay; and combining the first and third signal to generate a fourth signal.

The method may further comprise encoding the fourth signal using at least one of: MPEG-2 AAC, and MPEG-1 Layer III (mp3).

The method may further comprise dividing the first and second signals into a plurality of frequency bands and determining at least one time delay for each frequency band.

The method may further comprise dividing the first and second signals into a plurality of time frames and determining at least one time delay for each time frame.

The method may further comprise dividing the first and second signals into at least one of: a plurality of non overlapping time frames; a plurality of overlapping time frames; and a plurality of windowed overlapping time frames.

The method may further comprise determining for each time frame a first time delay associated with a start of the time frame of the first signal and a second time delay associated with an end of the time frame of the first signal.

The first frame and the second frame may comprise a plurality of samples, and the method may further comprise: selecting from the second signal at least one sample in a block defined as starting at the combination of the start of the time frame and the first time delay and finishing at the combination of the end of the time frame and the second time delay; and stretching the selected at least one sample to equal the number of samples of the first frame.

Determining the at least one time delay may comprise: generating correlation values for the first signal correlated with the second signal; and selecting the time value with the highest correlation value.

The method may further comprise generating a fifth signal, wherein the fifth signal comprises at least one of: the at least one time delay value; and an energy difference between the first and the second signals.

The method may further comprise multiplexing the fifth signal with the fourth signal to generate an encoded audio signal.

According to a fourth aspect of the invention there is provided a method comprising: dividing a first signal into at least a first part and a second part; decoding the first part to form a first channel audio signal; and generating a second channel audio signal from the first channel audio signal modified dependent on the second part, wherein the second part comprises a time delay value; and wherein generating the second channel audio signal by applying at least one time shift is dependent on the time delay value to the first channel audio signal.

The second part may further comprise an energy difference value, and wherein the method may further comprise generating the second channel audio signal by applying a gain to the first channel audio signal dependent on the energy difference value.

The method may further comprise dividing the first channel audio signal into at least two frequency bands, wherein generating the second channel audio signal may comprise modifying each frequency band of the first channel audio signal.

The second part may comprise at feast one first time delay value and at least one second time delay value, the first channel audio signal may comprise at least one frame defined from a first sample at a frame start time to a end sample at a frame end time, and the method may further comprise: copying the first sample of the first channel audio signal frame to the second channel audio signal at a time instant defined by the frame start time of the first channel audio signal and the first time delay value; and copying the end sample of the first channel audio signal to the second channel audio signal at a time instant defined by the frame end time of the first channel audio signal and the second time delay value.

The method may further comprise copying any other first channel audio signal frame samples between the first and end sample time instants.

The method may further comprising resampling the second channel audio signal to be synchronised to the first channel audio signal According to a fifth aspect of the invention there is provided a computer program product configured to perform a method comprising: determining at least one time delay between a first signal and a second signal; generating a third signal from the second signal dependent on the at least one time delay; and combining the first and third signal to generate a fourth signal.

According to a sixth aspect of the invention there is provided a computer program product configured to perform a method comprising: dividing a first signal into at least a first part and a second part; decoding the first part to form a first channel audio signal; and generating a second channel audio signal from the first channel audio signal modified dependent on the second part, wherein the second part comprises a time delay value; and wherein generating the second channel audio signal by applying at least one time shift is dependent on the time delay value to the first channel audio signal.

According to a seventh aspect of the invention there is provided an apparatus comprising: processing means for determining at least one time delay between a first signal and a second signal; signal processing means for generating a third signal from the second signal dependent on the at least one time delay; and combining means for combining the first and third signal to generate a fourth signal.

According to an eighth aspect of the invention there is provided an apparatus comprising: processing means for dividing a first signal into at least a first part and a second part; decoding means for decoding the first part to form a first channel audio signal; and signal processing means for generating a second channel audio signal from the first channel audio signal modified dependent on the second part, wherein the second part comprises a time delay value; and wherein the signal processing means is configured to generate the second channel audio signal by applying at least one time shift is dependent on the time delay value to the first channel audio signal.

BRIEF DESCRIPTION OF DRAWINGS

For better understanding of the present invention, reference will now be made by way of example to the accompanying drawings in which.

DESCRIPTION OF PREFERRED EMBODIMENTS OF THE INVENTION

Figure 1:
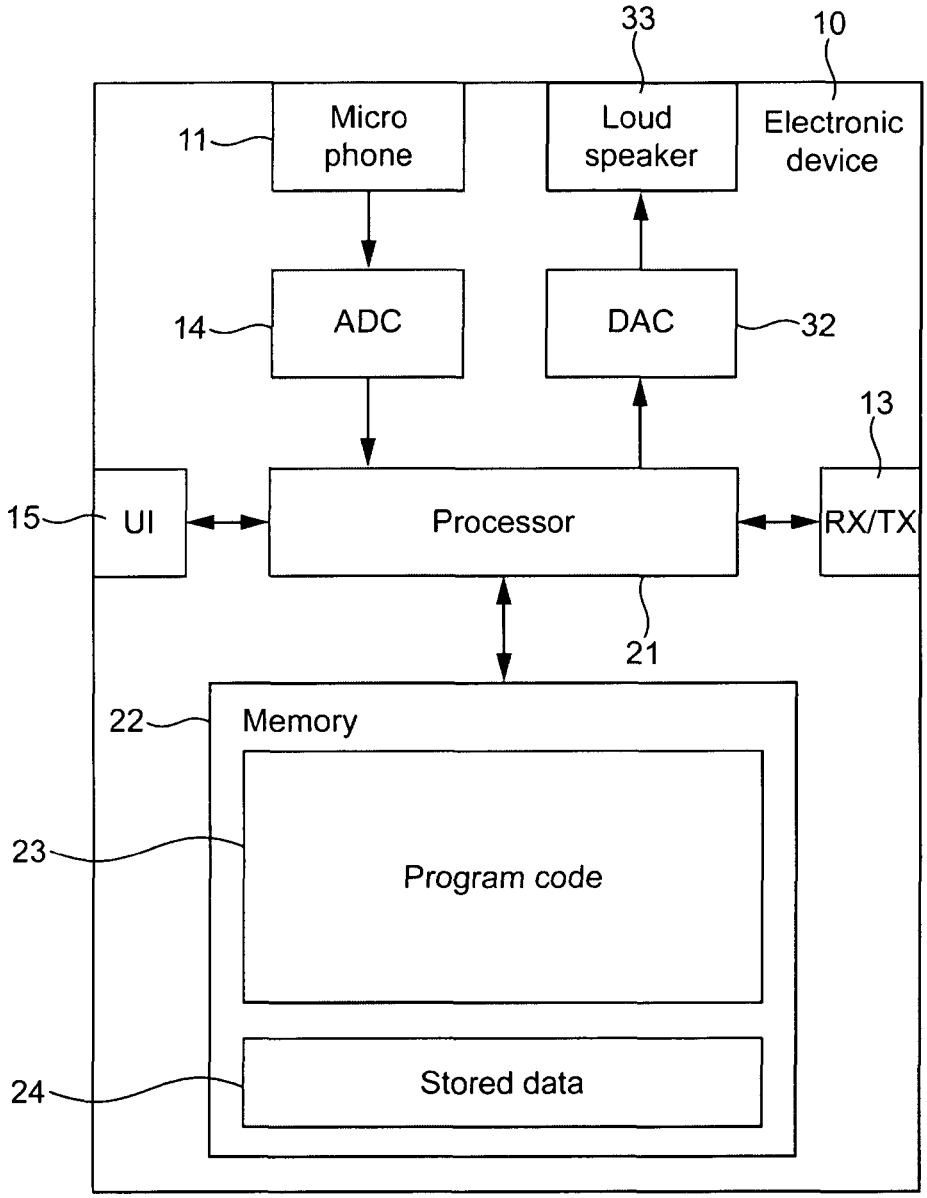
FIG. 1 shows schematically an electronic device employing embodiments of the invention.

The following describes in further detail suitable apparatus and possible mechanisms for the provision of enhancing encoding efficiency and signal fidelity for an audio codec. In this regard reference is first made to FIG. 1 which shows a schematic block diagram of an exemplary apparatus or electronic device 10, which may incorporate a codec according to an embodiment of the invention.

The electronic device 10 may for example be a mobile terminal or user equipment of a wireless communication system.

The electronic device 10 comprises a microphone 11, which is linked via an analogue-to-digital converter 14 to a processor 21. The processor 21 is further linked via a digital-to-analogue converter 32 to loudspeakers 33. The processor 21 is further linked to a transceiver (TX/RX) 13, to a user interface (UI) 15 and to a memory 22.

The processor 21 may be configured to execute various program codes. The implemented program codes may comprise encoding code routines. The implemented program codes 23 may further comprise an audio decoding code. The implemented program codes 23 may be stored for example in the memory 22 for retrieval by the processor 21 whenever needed. The memory 22 may further provide a section 24 for storing data, for example data that has been encoded in accordance with the invention.

The encoding and decoding code may in embodiments of the invention be implemented in hardware or firmware.

The user interface 15 may enable a user to input commands to the electronic device 10, for example via a keypad, and/or to obtain information from the electronic device 10, for example via a display. The transceiver 13 enables a communication with other electronic devices, for example via a wireless communication network. The transceiver 13 may in some embodiments of the invention be configured to communicate to other electronic devices by a wired connection.

It is to be understood again that the structure of the electronic device 10 could be supplemented and varied in many ways.

A user of the electronic device 10 may use the microphone 11 for inputting speech that is to be transmitted to some other electronic device or that is to be stored in the data section 24 of the memory 22. A corresponding application has been activated to this end by the user via the user interface 15. This application, which may be run by the processor 21, causes the processor 21 to execute the encoding code stored in the memory 22.

The analogue-to-digital converter 14 may convert the input analogue audio signal into a digital audio signal and provides the digital audio signal to the processor 21.

The processor 21 may then process the digital audio signal in the same way as described with reference to the description hereafter.

The resulting bit stream is provided to the transceiver 13 for transmission to another electronic device. Alternatively, the coded data could be stored in the data section 24 of the memory 22, for instance for a later transmission or for a later presentation by the same electronic device 10.

The electronic device 10 may also receive a bit stream with correspondingly encoded data from another electronic device via the transceiver 13. In this case, the processor 21 may execute the decoding program code stored in the memory 22. The processor 21 may therefore decode the received data, and provide the decoded data to the digital-to-analogue converter 32. The digital-to-analogue converter 32 may convert the digital decoded data into analogue audio data and outputs the analogue signal to the loudspeakers 33. Execution of the decoding program code could be triggered as well by an application that has been called by the user via the user interface 15.

The received encoded data could also be stored instead of an immediate presentation via the loudspeakers 33 in the data section 24 of the memory 22, for instance for enabling a later presentation or a forwarding to still another electronic device.

In some embodiments of the invention the loudspeakers 33 may be supplemented with or replaced by a headphone set which may communicate to the electronic device 10 or apparatus wirelessly, for example by a Bluetooth profile to communicate via the transceiver 13, or using a conventional wired connection.

Figure 3:
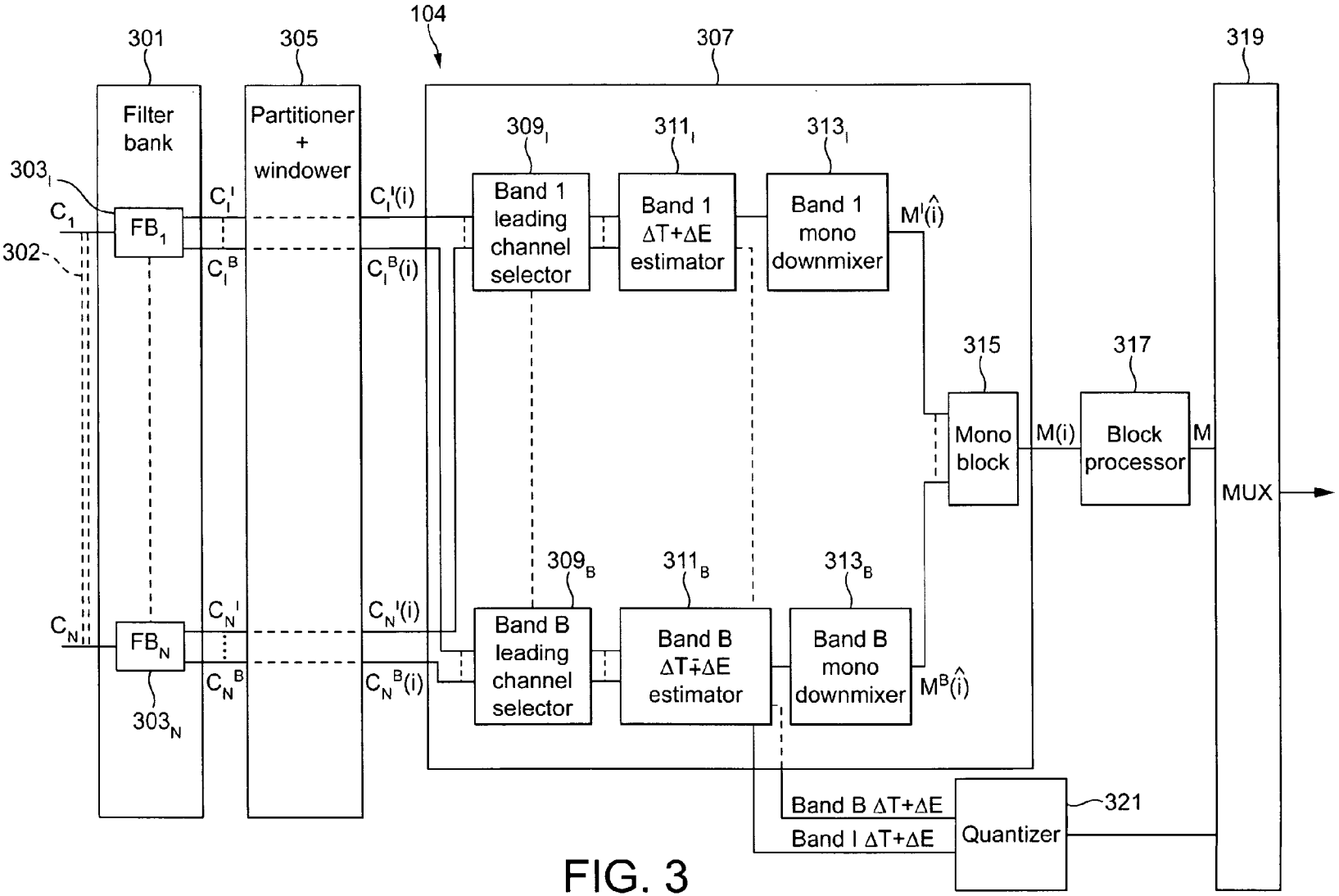
FIG. 3 shows schematically an audio encoder as employed in embodiments of the present invention as shown in FIG. 2.
Figure 4:
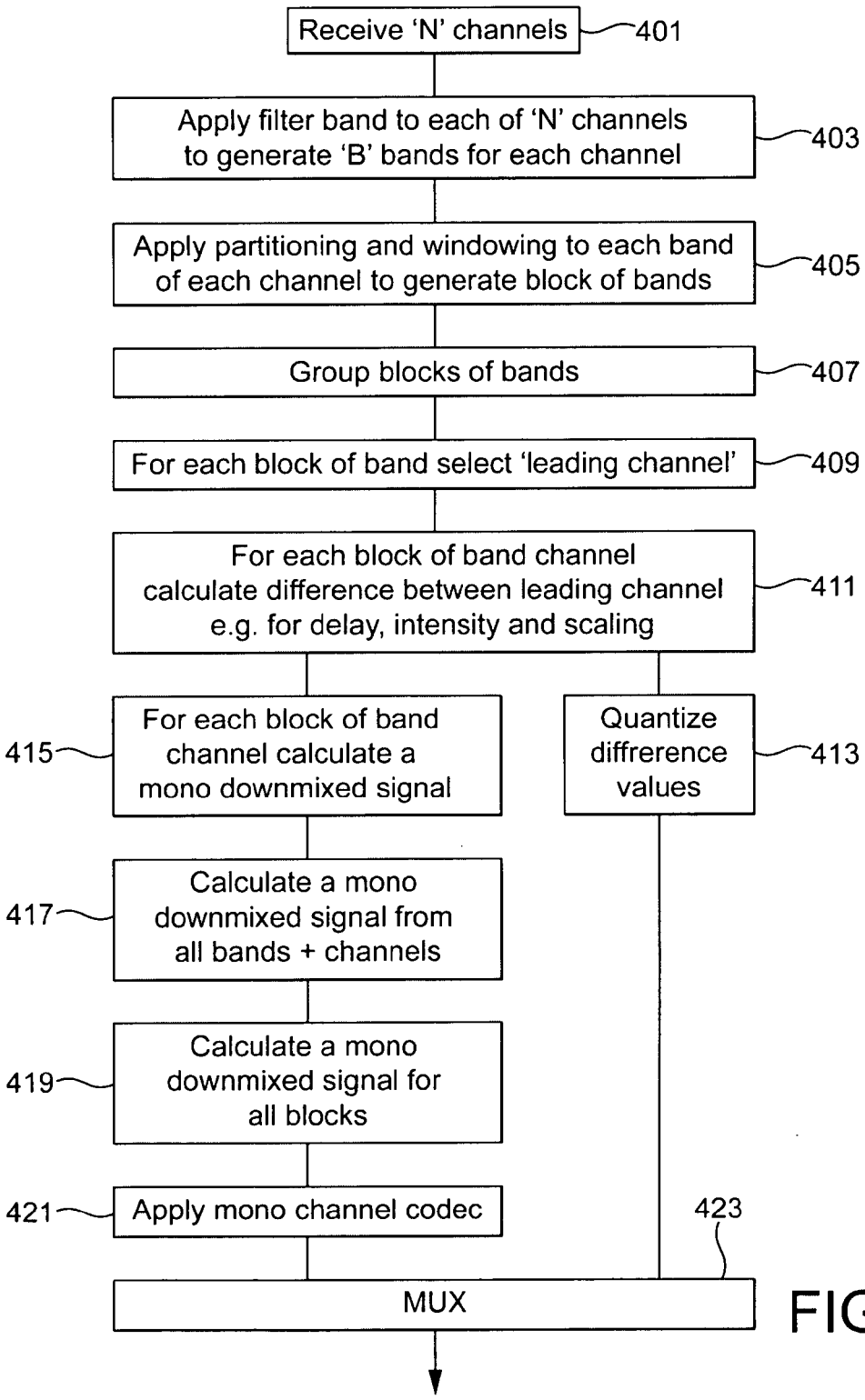
FIG. 4 shows a flow diagram showing the operation of an embodiment of the present invention encoding a multi-channel signal.
Figure 5:
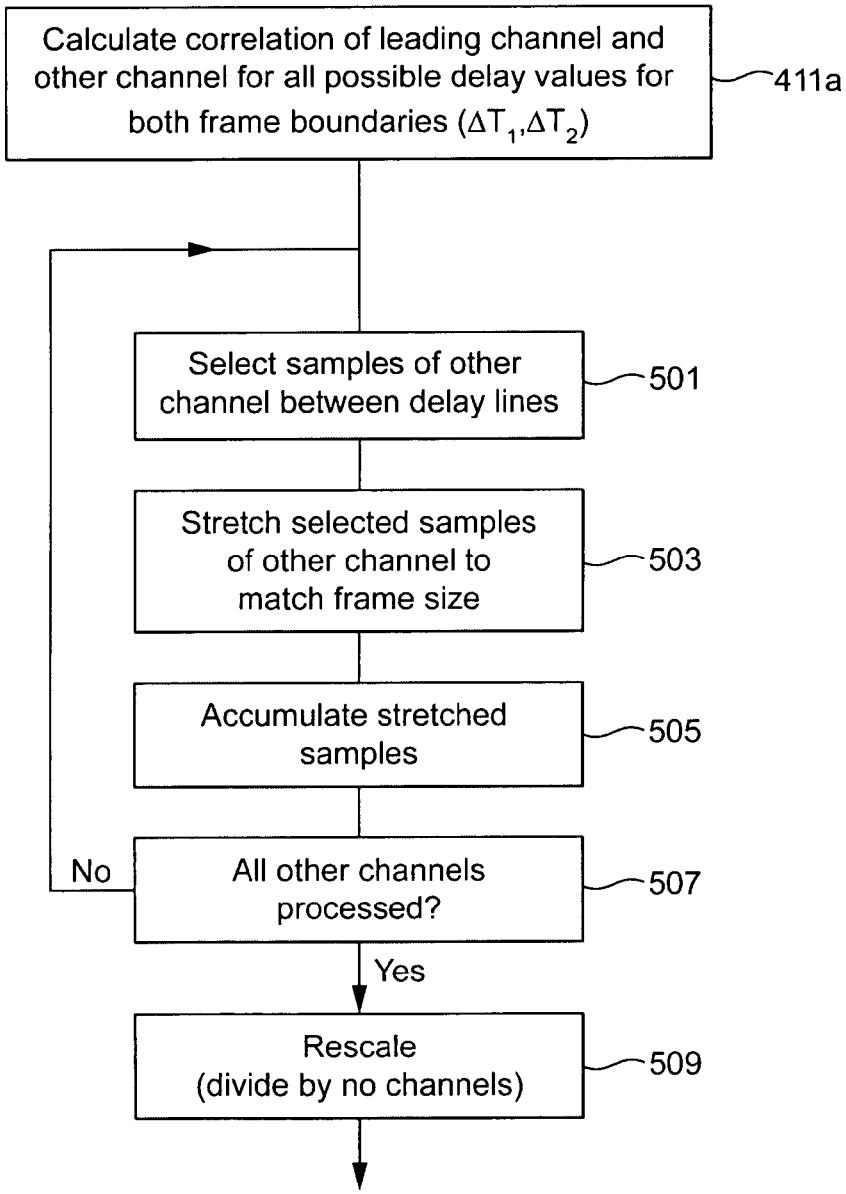
FIG. 5 shows in further detail the operation of generating a down mixed signal from a plurality of multi-channel blocks of bands as shown in FIG. 4.
Figure 12:
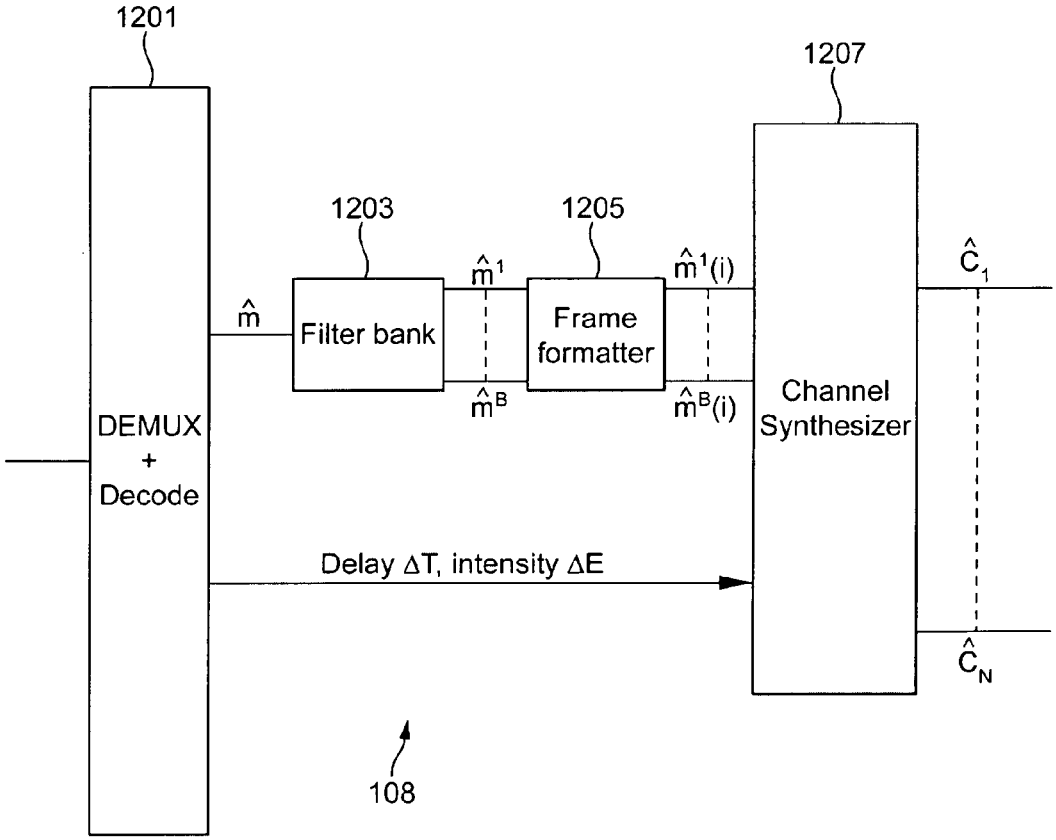
FIG. 12 shows a decoder according to embodiments of the invention.
Figure 13:
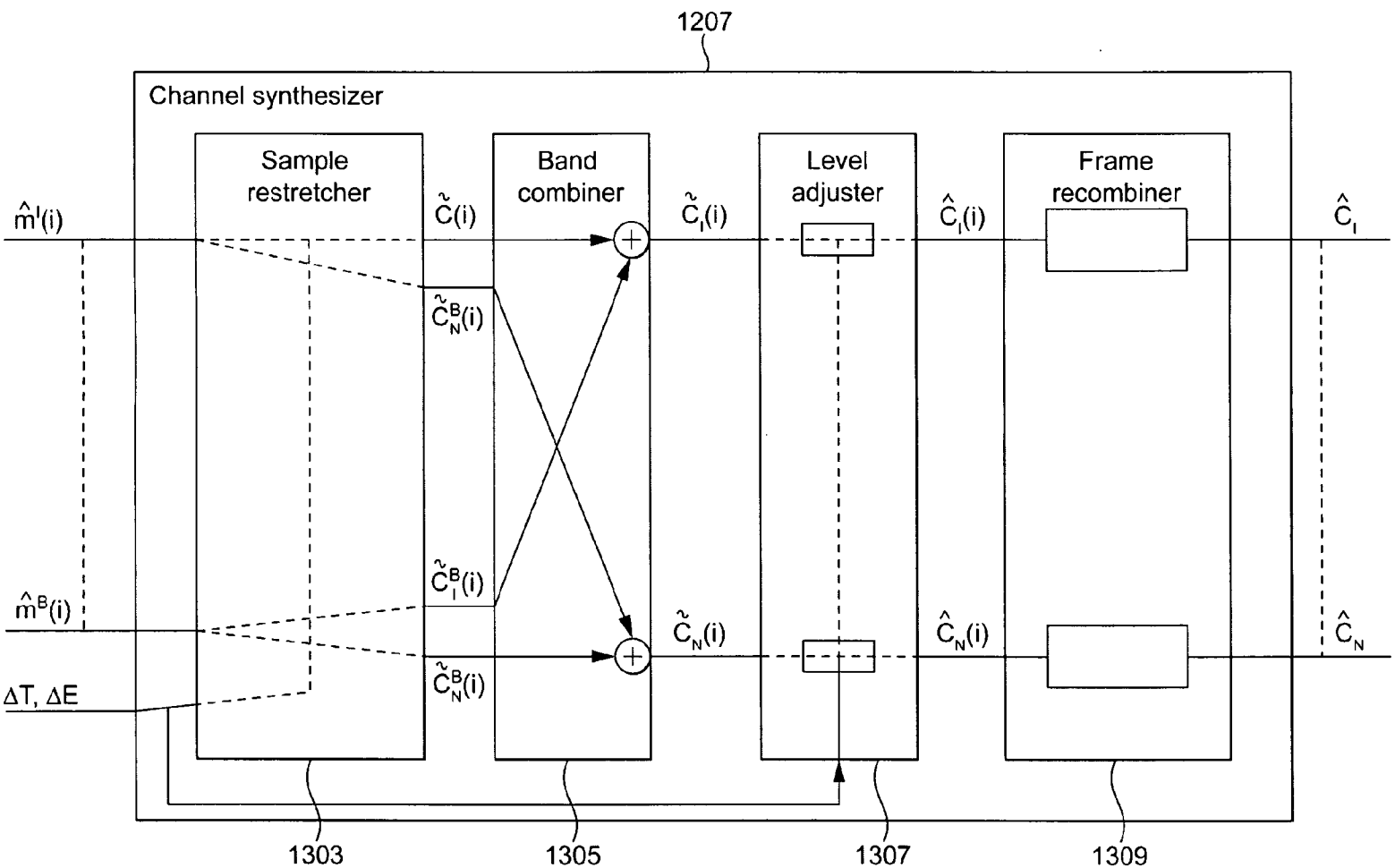
FIG. 13 shows schematically a channeled synthesizer according to embodiments of the invention.
Figure 14:
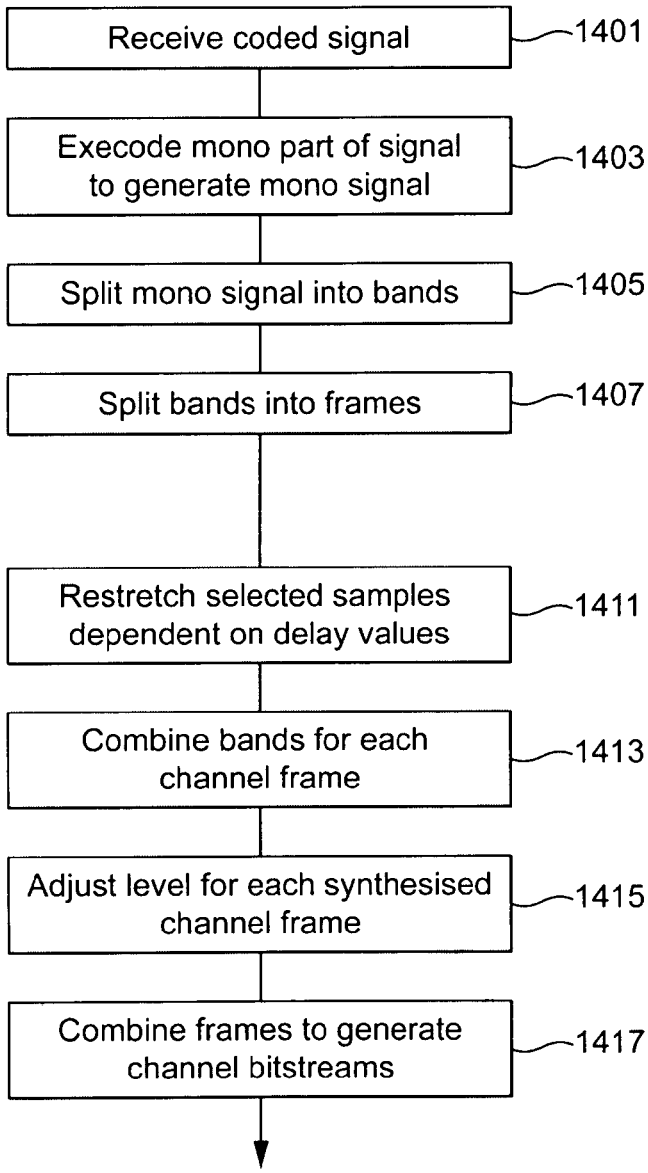
FIG. 14 shows a flow diagram detailing the operation of a decoder according to embodiments of the invention.

It would be appreciated that the schematic structures described in FIGS. 3, 12 and 13 and the method steps in FIGS. 4, 5 and 14 represent only a part of the operation of a complete audio codec as implemented in the electronic device shown in FIG. 1.

Figure 2:
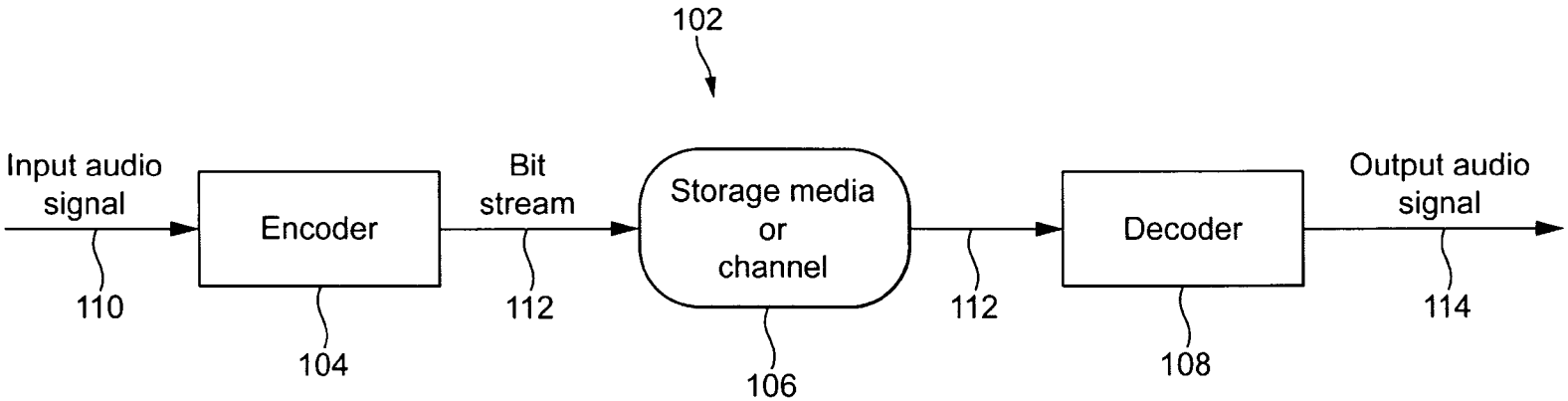
FIG. 2 shows schematically an audio codec system employing embodiments of the present invention.

The general operation of audio codecs as employed by embodiments of the invention is shown in FIG. 2. General audio coding/decoding systems consist of an encoder and a decoder, as illustrated schematically in FIG. 2. Illustrated is a system 102 with an encoder 104, a storage or media channel 106 and a decoder 108.

The encoder 104 compresses an input audio signal 110 producing a bit stream 112, which is either stored or transmitted through a media channel 106. The bit stream 112 can be received within the decoder 108. The decoder 108 decompresses the bit stream 112 and produces an output audio signal 114. The bit rate of the bit stream 112 and the quality of the output audio signal 114 in relation to the input signal 110 are the main features, which define the performance of the coding system 102.

FIG. 3 shows schematically an encoder 104 according to a first embodiment of the invention. The encoder 104 is depicted as comprising an input 302 divided into N channels $\{C_1, C_2, \ldots, C_N\}$. It is to be understood that the input 302 may be arranged to receive either an audio signal of N channels, or alternatively N audio signals from N individual audio sources, where N is a whole number equal to or greater than 2.

The receiving of the N channels is shown in FIG. 4 by step 401.

In the embodiments described below each channel is processed in parallel. However it would be understood by the person skilled in the art that each channel may be processed serially or partially serially and partially in parallel according to the specific embodiment and the associated cost/benefit analysis of parallel/serial processing.

The N channels are received by the filter bank 301. The filter bank 301 comprises a plurality of N filter bank elements 303. Each filter bank element 303 receives one of the channels and outputs a series of frequency band components of each channel. As can be seen in FIG. 3, the filter bank element for the first channel $C_1$ is the filter bank element $FB_1$ $\mathbf{303}_1$, which outputs the B channel bands $C_1^1$ to $C_1^B$. Similarly the filter bank element $FB_N$ $\mathbf{303}_N$ outputs a series of B band components for the N'th channel, $C_N^1$ to $C_N^B$. The B bands of each of these channels are output from the filter bank 301 and passed to the partitioner and windower 305.

The filter bank may, in embodiments of the invention be non-uniform. In a non-uniform filter bank the bands are not uniformly distributed. For example in some embodiments the bands may be narrower for lower frequencies and wider for high frequencies. In some embodiments of the invention the bands may overlap.

The application of the filter bank to each of the channels to generate the bands for each channel is shown in FIG. 4 by step 403.

The partitioner and windower 305 receives each channel band sample values and divides the samples of each of the band components of the channels into blocks (otherwise known as frames) of sample values. These blocks or frames are output from the partitioner and windower to the mono-block encoder 307.

In some embodiments of the invention, the blocks or frames overlap in time. In these embodiments, a windowing function may be applied so that any overlapping part with adjacent blocks or frames adds up to a value of 1.

Figure 8:
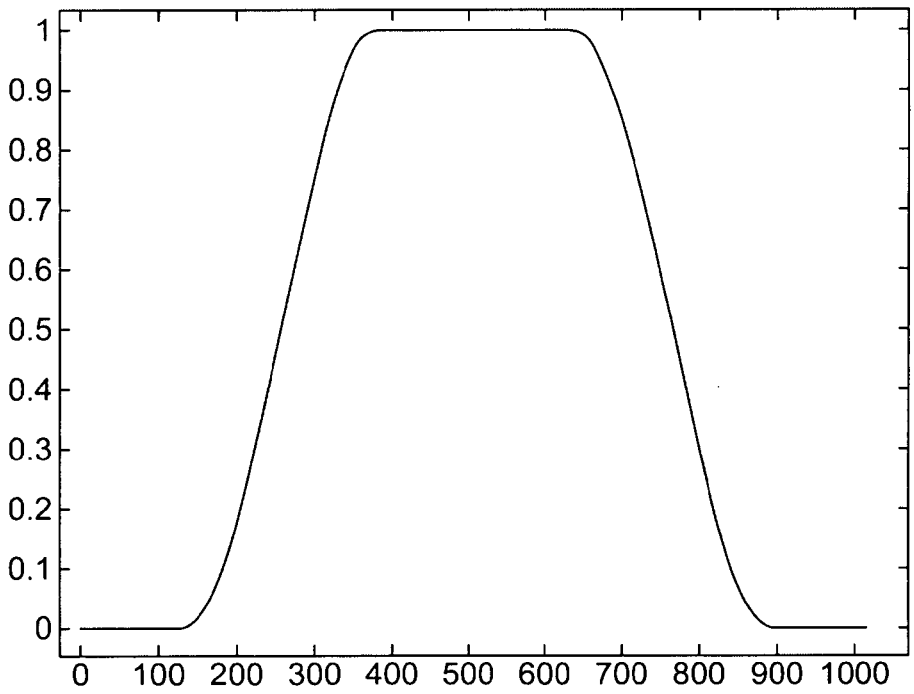
FIG. 8 shows a frame window as employed in embodiments of the invention.

An example of a windowing function can be seen in FIG. 8 and may be described mathematically according to the following equations.

$$\text{win_tmp} = \left[\sin\left(2\pi\frac{\frac{1}{2}+k}{wtl} - \frac{\pi}{2}\right) + 1\right] \Big/ 2,\ k = 0, \ldots, wtl - 1$$

$$win(k) = \begin{cases} 0, & k = 0, \ldots, zl \\ \text{win_tmp}(k - (zl+1)), & k = zl+1, \ldots, zl+wtl \\ 1, & k = zl+wtl, \ldots, wl/2 \\ 1, & wl/2+1, \ldots, wl/2+ol \\ \text{win_tmp}\left(\begin{array}{c} wl - zl - 1 - \\ (k - (wl/2 + ol + 1)) \end{array}\right), & k = wl/2+ol+1, \ldots, wl - zl - 1 \\ 0, & k = wl - zl, \ldots, wl - 1 \end{cases}$$

where wtl is the length of the sinusoidal part of the window, zl is the length of leading zeros in the window and ol is half of the length of ones in the middle of the window. In order that the windowing overlaps add up to 1 the following equalities must hold:

$$\begin{cases} zl + wtl + ol = \dfrac{\text{length}(win)}{2} \\ zl = ol \end{cases}.$$

The windowing thus enables that any overlapping between frames or blocks when added together equal a value of 1. Furthermore the windowing enables later processing to be carried out where there is a smooth transition between blocks.

In some embodiments of the invention, however, there is no windowing applied to the samples and the partitioner simply divides samples into blocks or frames.

In other embodiments of the invention, the partitioner and windower may be applied to the signals prior to the application of the filter bank. In other words, the partitioner and windower 305 may be employed prior to the filter bank 301 so that the input channel signals are initially partitioned and windowed and then after being partitioned and windowed are then fed to the filter bank to generate a sequence of B bands of signals.

The step of applying partitioning and windowing to each band of each channel to generate blocks of bands is shown in FIG. 4 by step 405.

The blocks of bands are passed to the mono-block encoder 307. The mono block encoder generates from the N channels a smaller number of down-mixed channels N'. In the example described below the value of N' is 1, however in embodiments of the invention the encoder 104 may generate more than one down-mixed channel. In such embodiments an additional step of dividing the N channels into N' groups of similar channels are carried out and then for each of the groups of channels the following process may be followed to produce a single mono-down-mixed signal for each group of channels. The selection of similar channels may be carried out by comparing channels for at least one of the bands for channels with similar values. However in other embodiments the grouping of the channels into the N' channel groups may be carried out by any convenient means.

The blocks (frames) of bands of the channels (or the channels for the specific group) are initially grouped into blocks of bands. In other words, rather than being divided according to the channel number, the audio signal is now divided according to the frequency band within which the audio signal occurs.

The operation of grouping blocks of bands is shown in FIG. 4 by step 407.

Each of the blocks of bands are fed into a leading channel selector 309 for the band. Thus for the first band, all of the blocks of the first band $C_x^1$ of channels are input to the band 1 leading channel selector $\mathbf{309}_1$ and the B'th band $C_x^B$ of channels are input to the band B leading channel selector $\mathbf{309}_B$. The other band signal data is passed to the respective band leading channel selector not shown in FIG. 3 in order to aid the understanding of the diagram.

Each band leading channel selector 309 selects one of the input channel audio signals as the "leading" channel. In the first embodiment of the invention, the leading channel is a fixed channel, for example the first channel of the group of channels input may be selected to be the leading channel. In other embodiments of the invention, the leading channel may be any of the channels. This fixed channel selection may be indicated to the decoder 108 by inserting the information into a transmission or encoding the information along with the audio encoded data stream or in some embodiments of the invention the information may be predetermined or hard-wired into the encoder/decoder and thus known to both without the need to explicitly signal this information in the encoding-decoding process.

In other embodiments of the invention, the selection of the leading channel by the band leading channel selector 309 is dynamic and may be chosen from block to block or frame to frame according to a predefined criteria. For example, the leading channel selector 309 may select the channel with the highest energy as the leading channel. In other embodiments, the leading channel selector may select the channel according to a psychoacoustic modelling criteria. In other embodiments of the invention, the leading channel selector 309 may select the leading channel by selecting the channel which has on average the smallest delay when compared to all of the other channels in the group. In other words, the leading channel selector may select the channel with the most average characteristics of all the channels in the group.

The leading channel may be denoted by $C_{\hat{l}}^{\hat{b}}(\hat{i})$.

In some embodiments of the invention, for example where there are only two channels, it may be more efficient to select a "virtual" or "imaginary" channel to be the leading channel. The virtual or imaginary leading channel is not a channel generated from a microphone or received but is considered to be a further channel which has a delay which is on average half way between the two channels or the average of all of the channels, and may be considered to have an amplitude value of zero.

The operation of selecting the leading channel for each block of bands is shown in FIG. 4 by step 409.

Each blocks of bands is furthermore passed to the band estimator 311, such that as can be seen in FIG. 3 the channel group first band audio signal data is passed to the band 1 estimator $\mathbf{311}_1$ and the channel group B'th band audio signal data is passed to the band B estimator $\mathbf{311}_B$.

The band estimator 311 for each block of band channel audio signals calculates or determines the differences between the selected leading channel $C_l^{\hat{b}}(\hat{i})$ (which may be a channel or an imaginary channel) and the other channels. Examples of the differences calculated between the selected leading channel and the other channels include the delay ΔT between the channels and the energy levels ΔE between the channels.

Figure 6:
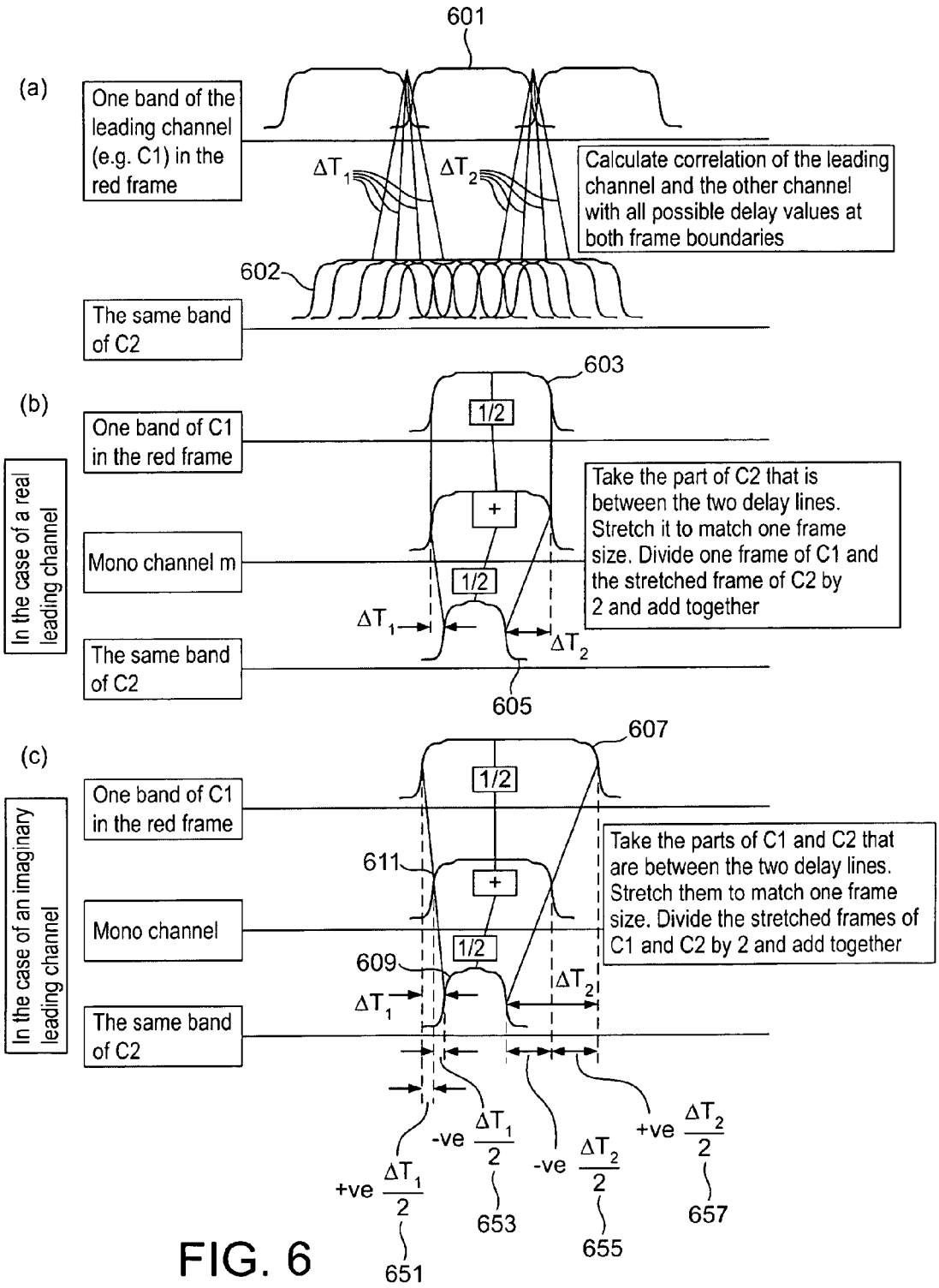
FIG. 6 shows a schematic view of signals being encoding according to embodiments of the invention.

FIG. 6, part (a), shows the calculation or determination of the delays between the selected leading channel 601 and a further channel 602 shown as $\Delta T_1$ and $\Delta T_2$.

The delay between the start of the start of a frame between the selected leading channel C1 601 and the further channel C2 602 is shown as $\Delta T_1$ and the delay between the end of the frame between the selected leading channel C1 601 and the further channel C2 602 is shown as $\Delta T_2$.

In some embodiments of the invention the determination/calculation of the delay periods $\Delta T_1$ and $\Delta T_2$ may be generated by performing a correlation between a window of sample values at the start of the frame of the first channel C1 601 against the second channel C2 602 and noting the correlation delay which has the highest correlation value. In other embodiments of the invention the determination of the delay periods may be implemented in the frequency domain.

In other embodiments of the invention the energy difference between the channels is determined by comparing the time or frequency domain channel values for each channel frequency block and across a single frame.

In other embodiments of the invention other measures of the difference between the selected leading channel and the other channels may be determined.

The calculating the difference between the leading channel and the other box of band channels is shown in shown in FIG. 4 by step 411.

This operation of determination of the difference between the selected leading channel and at least one other channel, which in the example shown in FIG. 5 is the delay is shown is shown by step 411*a*.

The output of the band estimator 311 is passed to the input of the band mono down mixer 313. The band mono down-mixer 313 receives the band difference values, for example the delay difference and the band audio signals for the channels (or group of channels) for that frame and generates a mono down-mixed signal for the band and frame.

Figure 7:
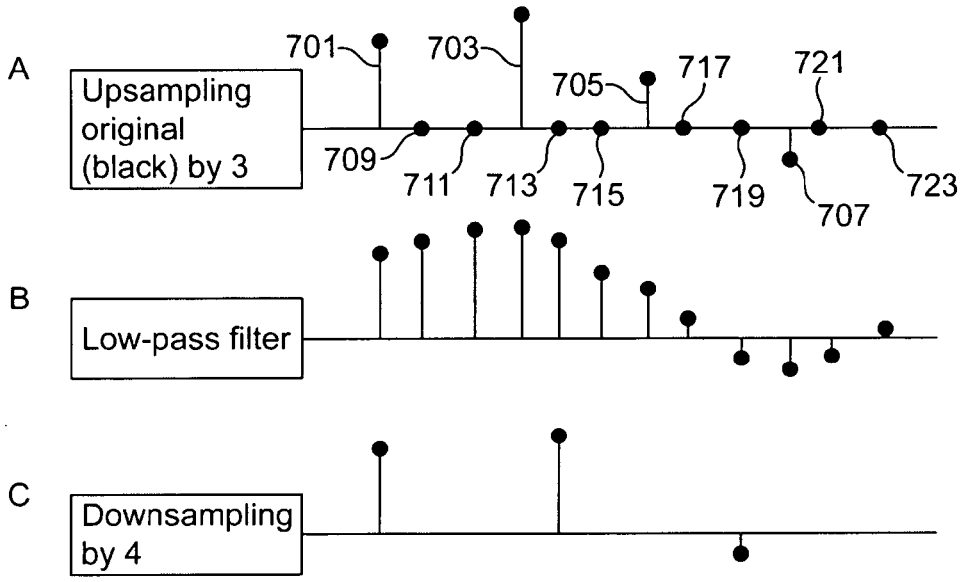
FIG. 7 shows schematically sample stretching according to embodiments of the invention.

This is shown in FIG. 4 by step 415 and is described in further detail with respect to FIGS. 5, 6 and 7.

The band mono down-mixer 313 generates the mono down-mixed signal for each band by combining values from each of the channels for a band and frame. Thus the B and 1 mono down mixer $\mathbf{313}_1$ receives the Band 1 channels and the Band 1 estimated values and produces a Band 1 mono down mixed signal. Similarly the Band B mono down mixer $\mathbf{313}_B$ receives the Band B channels and the Band B estimated difference values and produces a Band B mono down mixed signal.

In the following example a mono down mixed channel signal is generated for the Band 1 channel components and the difference values. However it would be appreciated that the following method could be carried out in a band mono down mixer 313 to produce any down mixed signal. Furthermore the following example describes an iterative process to generate a down mixed signal for the channels, however it would be understood by the person skilled in the art that a parallel operation or structure may be used where each channel is processed substantially at the same time rather than each channel taken individually.

The mono down-mixer with respect to the band and frame information for a specific other channel uses the delay information, $\Delta T_1$ and $\Delta T_2$, from the band estimator 311 to select samples of the other channel to be combined with the leading channel samples.

In other words the mono down-mixer selects samples between the delay lines reflecting the delay between the boundary of the leading channel and the current other channel being processed.

In some embodiments of the invention, such as the non-windowing embodiments or where the windowing overlapping is small, samples from neighbouring frames may be selected to maintain signal consistency and reduce the probability of artefact generation. In some embodiments of the invention, for example where the delay is beyond the frame sample limit and it is not possible to use the information from neighbouring frames the mono down-mixer 313 may insert zero-sample samples.

The operation of selecting samples between the delay lines is shown in FIG. 5 by step 501.

The mono down-mixer 313 then stretches the selected samples to fit the current frame size. As it would be appreciated by selecting the samples from the current other channel dependent on the delay values $\Delta T_1$ and $\Delta T_2$ there may be fewer or more samples in the selected current other channel than the number of samples in the leading channel band frame.

Thus for example where there are R samples in the other channel following the application of the delay fines on the current other channel and S samples in the leading channel frame the number of samples has to be aligned in order to allow simple combination down mixing of the sample values.

In a first embodiment of the present invention the R samples length signal is stretched to form the S samples by first up-sampling the signal by a factor of S, filtering the up-sampled signal with a suitable low-pass or all-pass filter and then down-sampling the filtered result by a factor of R.

This operation can be shown in FIG. 7 where for this example the number of samples in the selected leading channel frame is 3, S=3, and the number of samples in the current other channel is 4, R=4. FIG. 7(*a*) shows the other channel samples 701, 703, 705 and 707, and the introduced up-sample values. In the example of FIG. 7(*a*) following every selected leading channel frame sample a further two zero value samples are inserted. Thus that following sample 701, there are zero value samples 709 and 711 inserted, following sample 703 the zero value samples 713 and 715 are inserted, following sample 705, the zero value samples 717 and 719 are inserted, and following 707, the zero value samples 721 and 723 are inserted.

FIG. 7(*b*) shows the result of a low-pass filtering on the selected and up-sampling added samples so that the added samples now follow the waveform of the selected leading channel samples.

In FIG. 7(*c*), the signal is down-sampled by the factor R, where R=4 in this example. In other words the down-sampled signal is formed from the first sample and then every fourth sample, in other words the first, fifth and ninth samples are selected and the rest are removed.

The resultant signal now has the correct number of samples to be combined with the selected channel band frame samples.

In other embodiments of the invention, a stretching of the signal may be carried out by interpolating either linearly or non-linearly between the current other channel samples. In further embodiments of the invention, a combination of the two methods described above may be used. In this hybrid embodiment the samples from the current other channel within the delay lines are first up-sampled by a factor smaller than S, the up-sampled sample values are low-pass filtered in order that the introduced sample values follow the current other channel samples and then new points are selected by interpolation.

The stretching of samples of the current other channel to match the frame size of the leading channel is shown in step 503 of FIG. 5.

The mono down-mixer 313 then adds the stretched samples to a current accumulated total value to generate a new accumulated total value. In the first iteration, the current accumulated total value is defined as the leading channel sample values, whereas for every other following iteration the current accumulated total value is the previous iteration new accumulated total value.

The generating the new accumulated total value is shown in FIG. 5 by step 505.

The band mono down-mixer 313 then determines whether or not all of the other channels have been processed. This determining step is shown as step 507 in FIG. 5. If all of the other channels have been processed, the operation passes key step 509, otherwise the operation starts a new iteration with a further other channel to reprocess, in other words the operation passes back to step 501.

When all of the channels have been processed, the band mono down-mixer 313 then rescales the accumulated sample values to generate an average sample value per band value. In other words the band mono down-mixer 313 divides each sample value in the accumulated total by the number of channels to produce a band mono down-mixed signal. The operation of rescaling the accumulated total value is shown in FIG. 5 by step 509.

Each band mono down-mixer generates its own mono down-mixed signal. Thus as can be shown in FIG. 3 the band 1 mono down-mixer $\mathbf{313}_1$ produces a band 1 mono down-mixed signal $M^1(i)$ and the band B mono down-mixer $\mathbf{303}_B$ produces the band B mono down-mixed signal $M^B(i)$. The mono down-mixed signals are passed to the mono block 315.

Examples of the generation of the mono down-mixed signals for real and virtual selected channels in a two channel system are shown in FIGS. 6(*b*) and 6(*c*).

In FIG. 6(*b*), two channels C1 and C2 are down-mixed to form the mono-channel M. In selected leading channel in FIG. 6(*b*) is the C1 channel, of which one band frame 603 is shown. The other channel C2, 605, has for the associated band frame the delay values of $\Delta T_1$ and $\Delta T_2$.

Following the method shown above the band down mixer 313 would select the part of the band frame between the two delay lines generated by $\Delta T_1$ and $\Delta T_2$. The band down mixer would then stretch the selected frame samples to match the frame size of C1. The stretched selected part of the frame for C2 is then added to the frame C1. In the example shown in FIG. 6(*b*) the scaling is carried out prior to the adding of the frames. In other words the band down-mixer divides the values of each frame by the number of channels, which in this example is 2, before adding the frame values together.

With respect to FIG. 6(*c*), an example of the operation of the band mono down mixer where the selected leading channel is a virtual or imaginary leading channel is shown. In this example the band frame virtual channel has a delay which is half the band frame of the two normal channels of this example, the first channel C1 band frame 607 and the associated band frame of the second channel C2 609.

In this example the mono down-mixer 313 selects the frame samples for the first channel C1 frame that lies within the delay lines generated by +ve $\Delta T_1/2$ 651 and $\Delta T_2/2$ 657 and selects the frame samples for the second channel C2 that lie between the delay lines generated by −ve $\Delta T_1/2$ 653 and −ve $\Delta T_2/2$ 655.

The mono down-mixer 313 then stretches by a negative amount (shrinks) the first channel C1 according to the difference between the imaginary or virtual leading channel and the shrunk first channel C1 values are rescaled, which in this example means that the mono down-mixer 313 divides the shrunk values by 2. The mono down-mixer 313 similarly carries out a similar process with respect to the second channel C2 609 where the frame samples are stretched and divided by two. The mono down mixer 313 then combines the modified channel values to form the down-mixed mono-channel band frame 611.

The mono block 315 receives the mono down-mixed band frame signals from each of the band mono down-mixers 313 and generates a single mono block signal for each channel.

The down-mixed mono block signal may be generated by adding together the samples from each mono down-mixed audio signal. In some embodiments of the invention, a weighting factor may be associated with each band and applied to each band mono down-mixed audio signal to produce a mono signal with band emphasis or equalisation.

The operation of the combination of the band down-mixed signals to form a single frame down-mixed signal is shown is FIG. 4 by step 417.

The mono block 315 may then output the frame mono block audio signal to the block processor 317. The block processor 317 receives the mono block 315 generated mono down-mixed signal for all of the frequency bands for a specific frame and combines the frames to produce an audio down-mixed signal.

The optional operation of combining blocks of the signal is shown in FIG. 4 by step 419.

In some embodiments of the invention, the block processor 317 does not combine the blocks/frames.

In some embodiments of the invention, the block processor 317 furthermore performs an audio encoding process on each frame or a part of the combined frame mono down-mixed signal using a known audio codec.

Examples of audio codec processes which may be applied in embodiments of the invention include: MPEG-2 AAC also known as ISO/IEC 13818-7:1997; or MPEG-1 Layer III (mp3) also known as ISO/IEC 11172-3. However any suitable audio codec may be used to encoded the mono down-mixed signal.

As would be understood by the person skilled in the art the mono-channel may be coded in different ways dependent on the implementation of overlapping windows, non-overlapping windows, or partitioning of the signal. With respect to FIG. 9, there are examples shown of a mono-channel with overlapping windows FIG. 9(*a*) 901, a mono-channel with non-overlapping windows FIG. 9(*b*) 903 and a mono-channel where there is partitioning of the signal without any windowing or overlapping FIG. 9(*c*) 905.

Figure 9:
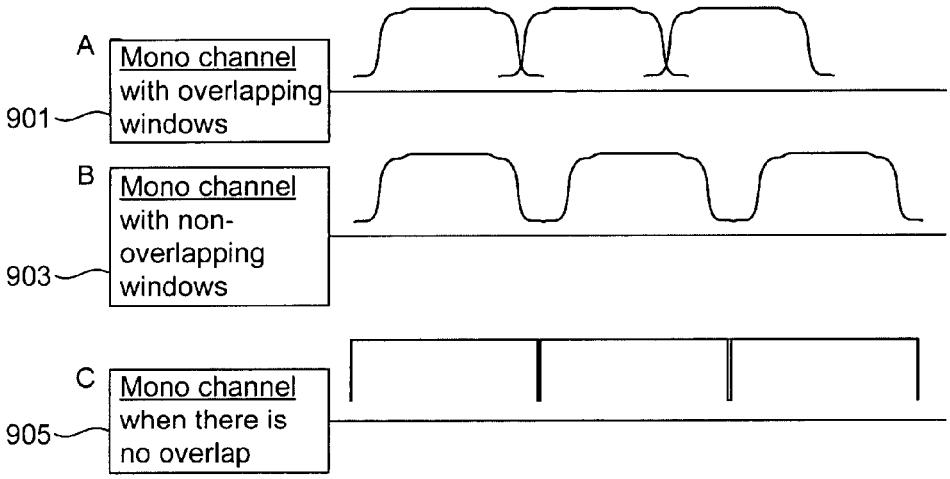
FIG. 9 shows the difference between windowing (overlapping and non-overlapping) and non-overlapping combination according to embodiments of the invention.

In embodiments of the invention when there is no overlap between adjacent frames as shown in FIG. 9(*c*) or when the overlap in windows adds up to one—for example by using the window function shown in FIG. 8, the coding may be implemented by coding the mono-channel with a normal conventional mono audio codec and the resultant coded values may be passed to the multiplexer 319.

However in other embodiments of the invention, when the mono channel has non-overlapping windows as shown in FIG. 9(*b*) or when the mono channel with overlapping windows is used but the values do not add to 1, the frames may placed one after each other so that there is no overlap. This in some embodiments thus generates a better quality signal coding as there is no mixture of signals with different delays. However it is noted that these embodiments would create more samples in to be encoded.

The audio mono encoded signal is then passed to the multiplexer 319.

The operation of encoding the mono channel is shown in FIG. 4 by step 421.

Furthermore the quantizer 321 receives the difference values for each block (frame) for each band describing the differences between the selected leading channel and the other channels and performs a quantization on the differences to generate a quantized difference output which is passed to the multiplexer 319. In some embodiments of the invention, variable length encoding may also be carried out on the quantized signals which may further assist error detection or error correction processes.

The operation of carrying out quantization of the different values is shown in FIG. 4 by step 413.

The multiplexer 319 receives the encoded mono channel signal and the quantized and encoded different signals and multiplexes the signal to form the encoded audio signal bitstream 112.

The multiplexing of the signals to form the bitstream is shown in FIG. 4 by step 423.

It would be appreciated that by encoding differences, for example both intensity and time differences, the multi-channel imaging effects from the down-mixed channel are more pronounced than the simple intensity difference and down-mixed channel methods previously used and are encoded more efficiently than the non-down mixed multi-channel encoding methods used.

With respect to FIGS. 12 and 13, a decoder according to an embodiment of the invention is shown. The operation of such a decoder is further described with respect to the flow chart shown in FIG. 14. The decoder 108 comprises a de-multiplexer and decoder 1201 which receives the encoded signal. The de-multiplexer and decoder 1201 may separate from the encoded bitstream 112 the mono encoded audio signal (or mono encoded audio signals in embodiments where more than one mono channel is encoded) and the quantized difference values (for example the time delay between the selected leading channel and intensity difference components).

Although the shown and described embodiment of the invention only has a single mono audio stream, it would be appreciated that the apparatus and processes described hereafter may be employed to generate more than one down mixed audio channel—with the operations described below being employed independently for each down mixed (or mono) audio channel.

The reception and de-multiplexing of the bitstream is shown in FIG. 14 by step 1401.

The de-multiplexer and decoder 1201 may then decode the mono channel audio signal using a decoder algorithm part from the codec used within the encoder 104.

The decoding of the encoded mono part of the signal to generate the decoded mono channel signal estimate is shown in FIG. 14 by step 1403.

The decoded mono or down mixed channel signal $\hat{M}$ is then passed to the filter bank 1203.

The filter bank 1203 receiving the mono (down mixed) channel audio signal performs a filtering using a filter bank 1203 to generate or split the mono signal into frequency bands equivalent to the frequency bands used within the encoder.

The filter bank 1203 thus outputs the B bands of the down mixed signal $\hat{M}^1$ to $\hat{M}^B$. These down mixed signal frequency band components are then passed to the frame formatter 1205.

The filtering of the down mixed audio signal into bands is shown in FIG. 14 by step 1405.

The frame formatter 1205 receives the band divided down mixed audio signal from the filter bank 1203 and performs a frame formatting process dividing the mono audio signals divided into bands further according to frames. The frame division will typically be similar in length to that employed in the encoder. In some embodiments of the invention, the frame formatter examines the down mixed audio signal for a start of frame indicator which may have been inserted into the bitstream in the encoder and uses the frame indicator to divide the band divided down mixed audio signal into frames. In other embodiments of the invention the frame formatter 1205 may divide the audio signal into frames by counting the number of samples and selecting a new frame when a predetermined number of samples have been reached.

The frames of the down mixed bands are passed to the channel synthesizer 1207.

The operation of splitting the bands into frames is shown in FIG. 14 by step 1407.

The channel synthesizer 1207 may receive the frames of the down mixed audio signals from the frame formatter and furthermore receives the difference data (the delay and intensity difference values) from the de-multiplexer and decoder 1201.

The channel synthesizer 1207 may synthesize a frame for each channel reconstructed from the frame of the down mixed audio channel and the difference data. The operation of the channel synthesizer is shown in further detail in FIG. 13.

As shown in FIG. 13, the channel synthesizer 1207 comprises a sample re-stretcher 1303 which receives a frame of the down mixed audio signal for each band and the difference information which may be, for example, the time delays $\Delta T$ and the intensity differences $\Delta E$.

The sample re-stretcher 1303, dependent on the delay information, regenerates an approximation of the original channel band frame by sample re-scaling or "re-stretching" the down mixed audio signal. This process may be considered to be similar to that carried out within the encoder to stretch the samples during encoding but using the factors in the opposite order. Thus using the example shown in FIG. 7 where in the encoder the 4 samples selected are stretched to 3 samples in the decoder the 3 samples from the decoder frame are re-stretched to form 4 samples. In an embodiment of the invention this may be done by interpolation or by adding additional sample values and filtering and then discarding samples where required or by a combination of the above.

In embodiments of the invention where there are leading and trailing window samples, the delay will typically not extend past the window region. For example, in a 44.1 kilohertz sampling system, the delay is typically between −25 and +25 samples. In some embodiments of the invention, where the sample selector is directed to select samples which extend beyond the current frame or window, the sample selector provides additional zero value samples.

The output of the re-stretcher 1303 thus produces for each synthesized channel (1 to N) a frame of sample values representing a frequency block (1 to B). Each synthesized channel frequency block frame is then input to the band combiner 1305.

Figure 10:
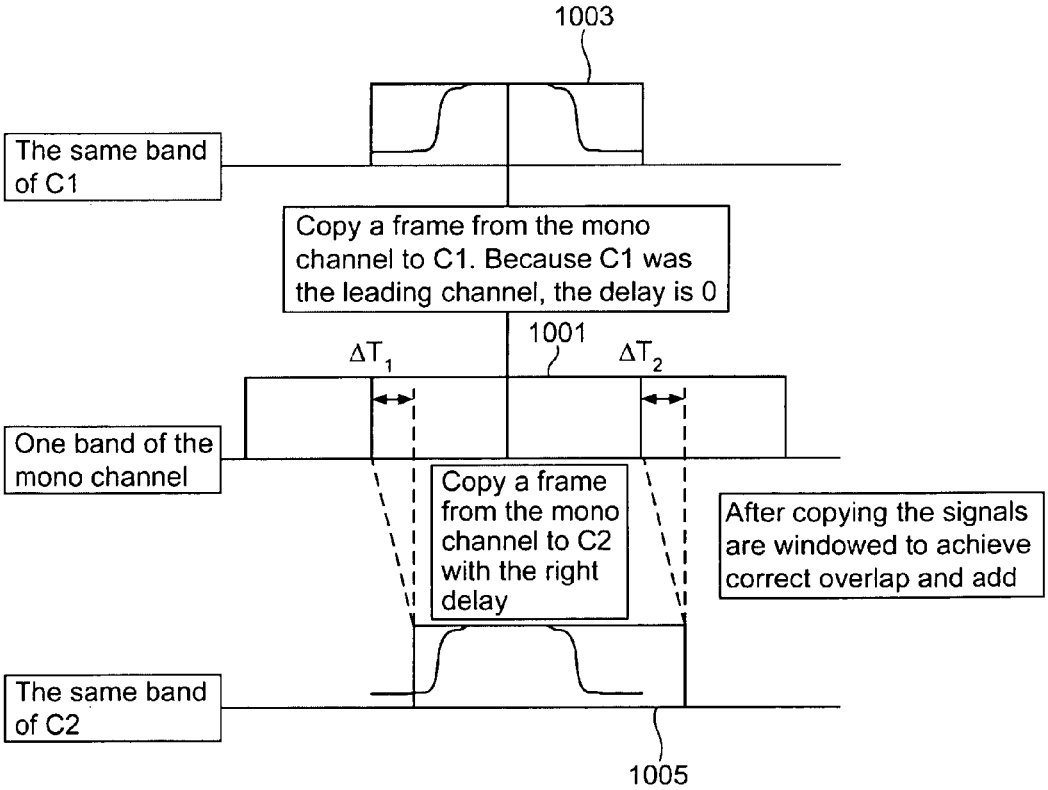
FIG. 10 shows schematically the decoding of the mono-signal to the channel in the decoder according to embodiments of the invention.

The example of the operation of the re-stretcher can be shown in FIG. 10. FIG. 10 shows a frame of the down mixed audio channel frequency band frame 1001. As shown in FIG.

10 the down mixed audio channel frequency band frame 1001 is copied to the first channel frequency band frame 1003 without modification. In other words the first channel C1 was the selected leading channel in the encoder and as such has a $\Delta T_1$ and $\Delta T_2$ values of 0.

The re-stretcher from the non zero $\Delta T_1$ and $\Delta T_2$ values re-stretches the frame of the down mixed audio channel frequency band frame 1001 to form the frame of the second channel C2 frequency band frame 1005.

The operation of re-stretching selected samples dependent on the delay values is shown in FIG. 14 by step 1411.

The band combiner 1305 receives the re-stretched down mixed audio channel frequency band frames and combines all of the frequency bands in order to produce an estimated channel value $\tilde{C}_1(i)$ for the first channel up to $\tilde{C}_N(i)$ for the N'th synthesized channel.

In some embodiments of the invention, the values of the samples within each frequency band are modified according to a scaling factor to equalize the weighting factor applied in the encoder. In other words to equalize the emphasis placed during the encoding process.

The combining of the frequency bands for each synthesized channel frame operation is shown in FIG. 14 by step 1413.

Furthermore the output of each channel frame is passed to a level adjuster 1307. The level adjuster 1307 applies a gain to the value according to the difference intensity value $\Delta E$ so that the output level for each channel is approximately the same as the energy level for each frame of the original channel.

The adjustment of the level (the application of a gain) for each synthesized channel frame is shown in FIG. 14 by step 1415.

Furthermore the output of each of the level adjuster 1307 is input to a frame re-combiner 1309. The frame re-combiner combines each frame for each channel in order to produce consistent output bitstream for each synthesized channel.

Figure 11:
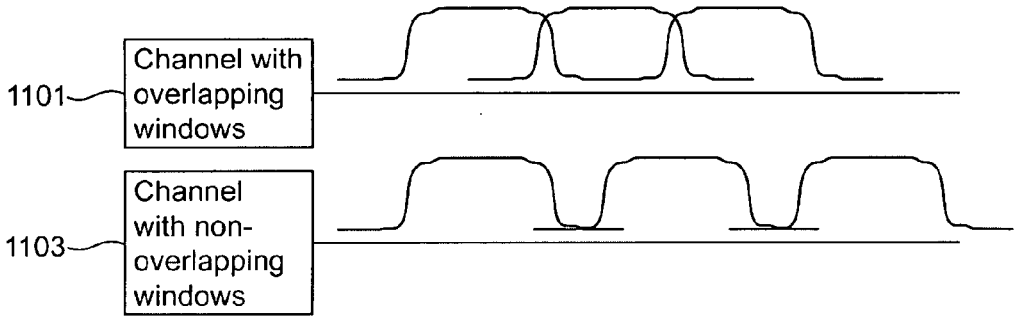
FIG. 11 shows schematically decoding of the mono-channel with overlapping and non-overlapping windows.

FIG. 11 shows two examples of frame combining. In the first example 1101, there is a channel with overlapping windows and in 1103, there is a channel with non-overlapping windows to be combined. These values may be generated by simply adding the overlaps together to produce the estimated channel audio signal. This estimated channel signal is output by the channel synthesizer 1207.

In some embodiments of the invention the delay implemented on the synthesized frames may change abruptly between adjacent frames and lead to artefacts where the combination of sample values also changes abruptly. In embodiments of the invention the frame recombiner 1309 further comprises a median filter to assist in preventing artefacts in the combined signal sample values. In other embodiments of the invention other filtering configurations may be employed or a signal interpolation may be used to prevent artefacts.

The combining of frames to generate channel bitstreams is shown in FIG. 14 by step 1417.

The embodiments of the invention described above describe the codec in terms of separate encoders 104 and decoders 108 apparatus in order to assist the understanding of the processes involved. However, it would be appreciated that the apparatus, structures and operations may be implemented as a single encoder-decoder apparatus/structure/operation. Furthermore in some embodiments of the invention the coder and decoder may share some/or all common elements.

Although the above examples describe embodiments of the invention operating within a codec within an electronic device 610, it would be appreciated that the invention as described below may be implemented as part of any variable rate/adaptive rate audio (or speech) codec. Thus, for example, embodiments of the invention may be implemented in an audio codec which may implement audio coding over fixed or wired communication paths.

Thus user equipment may comprise an audio codec such as those described in embodiments of the invention above.

It shall be appreciated that the term user equipment is intended to cover any suitable type of wireless user equipment, such as mobile telephones, portable data processing devices or portable web browsers.

Furthermore elements of a public land mobile network (PLMN) may also comprise audio codecs as described above.

In general, the various embodiments of the invention may be implemented in hardware or special purpose circuits, software, logic or any combination thereof. For example, some aspects may be implemented in hardware, while other aspects may be implemented in firmware or software which may be executed by a controller, microprocessor or other computing device, although the invention is not limited thereto. While various aspects of the invention may be illustrated and described as block diagrams, flow charts, or using some other pictorial representation, it is well understood that these blocks, apparatus, systems, techniques or methods described herein may be implemented in, as non-limiting examples, hardware, software, firmware, special purpose circuits or logic, general purpose hardware or controller or other computing devices, or some combination thereof.

The embodiments of this invention may be implemented by computer software executable by a data processor of the mobile device, such as in the processor entity, or by hardware, or by a combination of software and hardware. Further in this regard it should be noted that any blocks of the logic flow as in the Figures may represent program steps, or interconnected logic circuits, blocks and functions, or a combination of program steps and logic circuits, blocks and functions.

The memory may be of any type suitable to the local technical environment and may be implemented using any suitable data storage technology, such as semiconductor-based memory devices, magnetic memory devices and systems, optical memory devices and systems, fixed memory and removable memory. The data processors may be of any type suitable to the local technical environment, and may include one or more of general purpose computers, special purpose computers, microprocessors, digital signal processors (DSPs) and processors based on multi-core processor architecture, as non-limiting examples.

Embodiments of the inventions may be practiced in various components such as integrated circuit modules. The design of integrated circuits is by and large a highly automated process. Complex and powerful software tools are available for converting a logic level design into a semiconductor circuit design ready to be etched and formed on a semiconductor substrate.

Programs, such as those provided by Synopsys, Inc. of Mountain View, Calif. and Cadence Design, of San. Jose, Calif. automatically route conductors and locate components on a semiconductor chip using well established rules of design as well as libraries of pre-stored design modules. Once the design for a semiconductor circuit has been completed, the resultant design, in a standardized electronic format (e.g., Opus, GDSII, or the like) may be transmitted to a semiconductor fabrication facility or "fab" for fabrication.

The foregoing description has provided by way of exemplary and non-limiting examples a full and informative description of the exemplary embodiment of this invention. However, various modifications and adaptations may become apparent to those skilled in the relevant arts in view of the foregoing description, when read in conjunction with the accompanying drawings and the appended claims. However, all such and similar modifications of the teachings of this invention will still fall within the scope of this invention as defined in the appended claims.

The invention claimed is:

1. An apparatus comprising at least one processor and at least one memory including computer program code the at least one memory and the computer program code configured to, with the at least one processor, cause the apparatus at least to:

divide a first and a second signal into a plurality of time frames;

determine a first time delay associated with a delay between a start of a time frame of the first signal and a start of a time frame of the second signal;

determine a second time delay associated with a delay between an end of the time frame of the first signal and an end of the time frame of the second signal;

select from the second signal at least one sample from a block of samples, wherein the block of samples is defined as starting at the start of the time frame of the second signal offset by the first time delay and finishing at the end of the time frame of the second signal offset by the second time delay;

generate a third signal by stretching the selected at least one sample to equal the number of samples of the time frame of the first signal; and combine the first and third signal to generate a fourth signal.

2. The apparatus as claimed in claim 1, wherein the at least one memory and the computer program code are further configured to, with the at least one processor, cause the apparatus at least to encode the fourth signal using at least one of:

MPEG-2 AAC, and

MPEG-1 Layer III (mp3).

3. The apparatus as claimed in claim 1, wherein the at least one memory and the computer program code are further configured to, with the at least one processor, cause the apparatus at least to:

to divide the first and second signals into at least one of:

a plurality of non overlapping time frames;

a plurality of overlapping time frames; and a plurality of windowed overlapping time frames.

4. The apparatus as claimed in claim 1, wherein the at least one memory and the computer program code are further configured to, with the at least one processor, cause the apparatus at least to:

determine the first time delay and the second time delay by:

generating correlation values for the first signal correlated with the second signal; and selecting a time value with the highest correlation value.

5. The apparatus as claimed in claim 1, wherein the at least one memory and the computer program code are further configured to, with the at least one processor, cause the apparatus at least to:

generate a fifth signal, and wherein the fifth signal comprises at least one of:

the at least one first time delay value and the second time delay value; and an energy difference between the first and the second signals.

6. The apparatus as claimed in claim 5, wherein the at least one memory and the computer program code are further configured to, with the at least one processor, cause the apparatus at least to:

multiplex the fifth signal with the fourth signal to generate an encoded audio signal.

7. An apparatus comprising at least one processor and at least one memory including computer program code the at least one memory and the computer program code configured to, with the at least one processor, cause the apparatus at least to:

divide a first signal into at least a first part and a second part, wherein the second part comprises at least one first time delay value and at least one second time delay value;

decode the first part to form a first channel audio signal, wherein the first channel audio signal comprises at least one frame defined from a first sample at a frame start time to an end sample at a frame end time; and generate a second channel audio signal from the first channel audio signal modified based at least in part on the second part by the apparatus being caused to copy the first sample of the first channel audio signal frame to the second channel audio signal at a time instant defined by the frame start time of the first channel audio signal and the first time delay value, and copy the end sample of the first channel audio signal to the second channel audio signal at a time instant defined by the frame end time of the first channel audio signal and the second time delay value.

8. The apparatus as claimed in claim 7, wherein the second part further comprises an energy difference value, and wherein the at least one memory and the computer program code are further configured to, with the at least one processor, cause the apparatus at least to:

generate the second channel audio signal by applying a gain to the first channel audio signal base at least in part on the energy difference value.

9. The apparatus as claimed in claim 7, wherein the at least one memory and the computer program code are further configured to, with the at least one processor, cause the apparatus at least to:

divide the first channel audio signal into at least two frequency bands, wherein the generation of the second channel audio signal is by modifying each frequency band of the first channel audio signal.

10. The apparatus as claimed in claim 7, wherein the at least one memory and the computer program code are further configured to, with the at least one processor, cause the apparatus at least to:

copy any other first channel audio signal frame samples between the first and end sample time instants, and resample the second channel audio signal to be synchronized to the first channel audio signal.

11. A method comprising:

dividing a first and a second signals into a plurality of time frames;

determining a first time delay associated with a delay between a start of a time frame of the first signal and a start of a time frame of the second signal;

determining a second time delay associated with a delay between an end of the time frame of the first signal and an end of the time frame of the second signal;

selecting from the second signal at least one sample from a block of samples, wherein the block of samples is defined as starting at the start of the time frame of the second signal offset by the first time delay and finishing at the end of the time frame of the second signal offset by the second time delay;

generating a third signal by stretching the selected at least one sample to equal the number of samples of the time frame of the first signal; and combining the first and third signal to generate a fourth signal.

12. The method as claimed in claim 11, further comprising encoding the fourth signal using at least one of:

MPEG-2 AAC, and

MPEG-1 Layer III (mp3).

13. The method as claimed in claim 11, further comprising dividing the first and second signals into at least one of:

a plurality of non overlapping time frames;

a plurality of overlapping time frames; and a plurality of windowed overlapping time frames.

14. The method as claimed in claims 11, wherein determining the first time delay and the second time delay comprises:

generating correlation values for the first signal correlated with the second signal; and selecting a time value with the highest correlation value.

15. The method as claimed in claims 11, further comprising generating a fifth signal, wherein the fifth signal comprises at least one of:

the first time delay value and the second time delay value; and an energy difference between the first and the second signals.

16. The method as claimed in claim 15, further comprising: multiplexing the fifth signal with the fourth signal to generate an encoded audio signal.

17. A method comprising:

dividing a first signal into at least a first part and a second part, wherein the second part comprises at least one first time delay value and at least one second time delay value;

decoding the first part to form a first channel audio signal, wherein the first channel audio signal comprises at least one frame defined from a first sample at a frame start time to an end sample at a frame end time; and generating a second channel audio signal from the first channel audio signal modified base at least in part on the second part by copying the first sample of the first channel audio signal frame to the second channel audio signal at a time instant defined by the frame start time of the first channel audio signal and the first time delay value, and copying the end sample of the first channel audio signal to the second channel audio signal at a time instant defined by the frame end time of the first channel audio signal and the second time delay value.

18. The method as claimed in claim 17, wherein the second part further comprises an energy difference value, and wherein the method further comprises generating the second channel audio signal by applying a gain to the first channel audio signal base at least in part on the energy difference value.

19. The method as claimed in claim 17, further comprising dividing the first channel audio signal into at least two frequency bands, wherein generating the second channel audio signal comprises modifying each frequency band of the first channel audio signal.

20. The method as claimed in claim 17, further comprising:

copying any other first channel audio signal frame samples between the first and end sample time instants, and resampling the second channel audio signal to be synchronised to the first channel audio signal.

* * * * *